United States Patent [19]

Litwin

[11] Patent Number: 4,706,855

[45] Date of Patent: Nov. 17, 1987

[54] ONE-PIECE CONTAINER CLOSURE OF THE DISPENSING TYPE

[76] Inventor: Walter J. Litwin, 4471 N. Forestview Ave., Chicago, Ill. 60656

[21] Appl. No.: 892,958

[22] Filed: Aug. 4, 1986

[51] Int. Cl.[4] ..... B22D 37/00

[52] U.S. Cl. ..... 222/511; 222/562

[58] Field of Search ..... 222/511, 518, 546, 544, 222/562, 556, 213; 251/339, 341, 342

[56] References Cited

U.S. PATENT DOCUMENTS

| | | | |
|---|---|---|---|
| 2,161,230 | 6/1939 | Nelson | 215/100 |
| 2,614,732 | 10/1952 | Pararra | 222/51 |
| 3,120,908 | 2/1964 | Szajna et al. | 222/511 |
| 3,400,866 | 9/1968 | Fattori | 222/511 |
| 3,443,728 | 5/1969 | Scholle | 222/511 |
| 3,972,452 | 8/1976 | Welsh | 222/501 |
| 4,211,348 | 7/1980 | Scholle | 222/498 |
| 4,248,362 | 2/1981 | Welsh et al. | 222/505 |

*Primary Examiner*—Joseph J. Rolla
*Assistant Examiner*—Kenneth Noland
*Attorney, Agent, or Firm*—Donald W. Margolis

[57] ABSTRACT

There is provided, for a container having a cylindrical outlet, a one-piece deformable dispensing closure in the form of a cap including a circular end wall having a depending peripheral skirt for securing it to the outlet. The end wall includes a scoreline which defines a segment intersecting a portion of the end wall. A complex hollow seal, positioned and sized for insertion into the container outlet, depends from the inner surface of the end wall. The seal also includes a tapered external lip for forming a partially releasable seal with the internal surface of the container outlet. There is a dispensing opening through the end wall. When inward pressure is exerted on the outer surface of the end wall a portion of the end wall within the scoreline is moved inwardly, moving with it a portion of the seal and tapered lip which is in registration therewith. This serves to release the moved portion of the tapered lip from its sealing relation with the internal surface of the container outlet, while the portion of the seal and tapered lip which are outside of the scoreline remain in sealing relation with the outlet. When inward pressure on the end wall is terminated the inwardly moved portion of the end wall and seal move outward and return the moved portion of the tapered lip to its normal sealing relation with the outlet. A modified form of the closure which is lockable and child resistant is also taught.

20 Claims, 7 Drawing Figures

FIG. 2
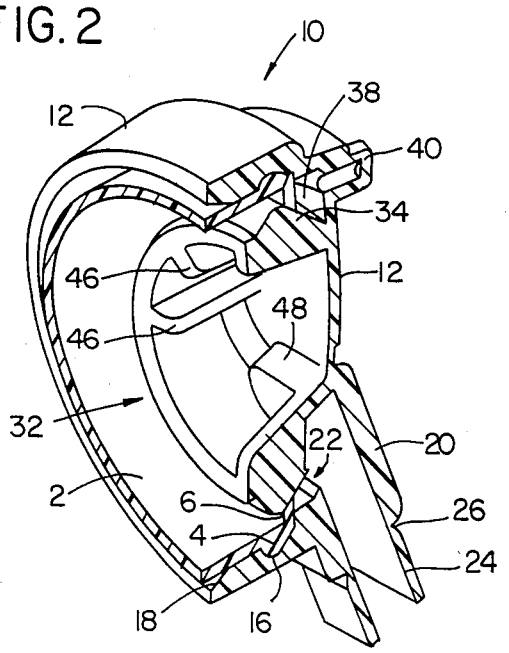
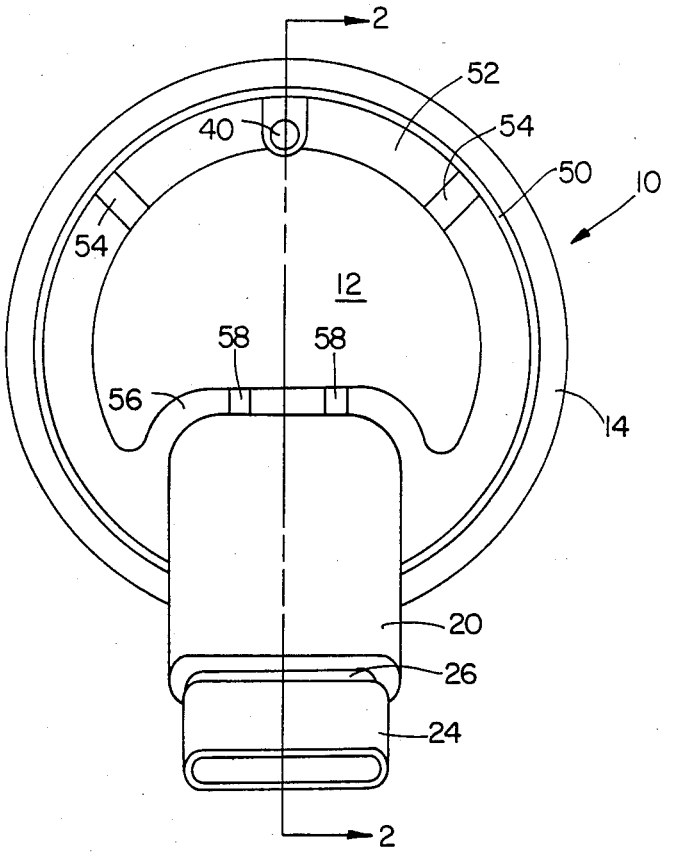
FIG. 1

ONE-PIECE CONTAINER CLOSURE OF THE DISPENSING TYPE

BACKGROUND OF THE INVENTION a. Field of the Invention

This invention relates in general to new and useful improvements in movable actuators for the outlet elements of containers. More specifically, it relates to a novel one-piece movable actuator of the dispensing type for use with a container for fluid. Such a movable actuator system, sometimes termed a closure or valve, is adapted for association with the neck or other outlet opening of a container, for use in containing, and in incrementally dispensing fluids from such a container. In one embodiment the actuator system is designed to be child resistant.

b. Discussion of the Prior Art

There are many types of potable and non-potable fluids which are distributed in containers. It is often desirable to be able to dispense such liquids from containers in controlled quantities from time to time. Typical examples of such potable fluids include water, wine, milk, fruit juices and so on. Typical examples of non-potable fluids include antifreeze, motor oil, household cleaners, pesticides, paint thinners, bleach, laundry detergents and so on. An important requirement for fluid dispensing system closures for containers is that the closure should be capable of being sealed fluid tight when it is not desired to dispense fluid from the container, while the same closure should also be readily adapted for the easy, but controlled, dispensing of fluids from the container.

In the past, one simple solution to the problem has been to provide the container with a dispensing outlet, such as a spout, which spout is in turn provided with a removable closure cap. This arrangement, although simple, has the disadvantage that the closure cap for the spout is often lost or misplaced. Such an arrangement has the further disadvantage that it does not allow for the convenient maintenance of the dispensing outlet in a constant gravity fed position. A second solution to the problem in the past has been the provision of a container closure with an internal valve construction. While such closures have sometimes been satisfactory for sealing containers, such container closures have usually been relatively complicated, multi-part, and costly to manufacture, and have therefore been unsuitable or undesirable for economical mass production and mass distribution.

A number of less complicated, less costly closure systems which include a one piece internal valve construction have been taught by the prior art. For example, U.S. Pat No. 3,120,908 discloses a one-piece resilient closure system for use with containers. The closure of this reference is generally in the form of a cap having an end wall with a depending skirt for engagement over the neck of a container to provide a seal between the closure and the container neck. The closure of this reference also includes a cylindrical plug which depends from the inner surface of the end wall. The plug is designed to be located concentrically within the neck of the container to form a releasable seal between the outer circumference of the plug and the inner circumference of the neck of the container. This sealing relationship between the plug and the neck of the container is formed by an upwardly facing circular seat on the outer circumference of the plug, which circular seat engages the inner circumference of a circular internal lip in the neck of the container to thereby form a seal which normally retains fluids within the container. When the end wall of the closure is depressed it moves the entire plug inward so that the circular seat is moved to a 360° released, non-sealing position from the lip in the neck so that fluids can be dispensed from the container. The closure system of this reference is designed for use in a manner such that, in order to avoid leakage, the container is normally placed upwards, with the closure out of constant gravity fed contact with the fluid in the container, when it is not being used to dispense such fluids. The very fact that the plug is designed to move the entire 360° circumference of the seat out of sealing contact with the internal lip of the container neck provides a large area for potential leakage between the plug and the lip. This makes the system undesirable for use with a container in which fluids are in constant gravity fed contact with such a closure seal. Indeed, study of this reference will show that the closure system is not suggested for use in constant gravity fed contact with fluids in the container, but rather is taught for use in a system in which the container is normally placed in an upright position, with the closure out of contact with the fluids in the container, when fluids are not being dispensed. It has now been determined that this requirement for being placed in an upright position is due, not only to the fact that the structure of the closure of this reference is designed for 360° release of the seal, but is also due to the fact that the closure structure lacks means to assure that the seat on the plug within the neck of the container will be free of leakage over its entire 360° circumference. One of the reasons that the closure structure of the reference lacks reliability as to leakage prevention is that the plug is a smooth right cylinder which lacks means for assuring either its own cylindrical shape, or shape retention for its circular facing seat. Additionally, the plug lacks means for continuously urging the facing seat on the plug against the lip in the neck of the container. This results in a plug structure which has both a limited ability to urge and flex its outer facing seat against the lip on the neck of the container, and a lack of assurance that the plug and facing seat will retain their shape. All of these factors effect the ability of the plug of this reference to maintain a tight closure with the lip on the neck of the container. For all of these reasons this simple prior art closure design is not completely desirable for use with a fluid container, especially not on one in which there is constant gravity fed contact and pressure between the fluid in the container and the closure, and in which controlled flow of fluid without leakage is desired.

Also in the prior art, U.S. Pat Nos. 3,400,866, and 3,443,728 describe one-piece dispenser closure valves in which the valve is opened by placing upward and outward pressure on an external tab.

SUMMARY OF THE INVENTION

The closure system of the present invention is of simple and economical one-piece construction, one that can be adapted for re-use, or one which, by reason of its simplicity and economy of manufacture, can be discarded when the contents of the container with which it is associated are fully discharged.

This is accomplished by providing an improvement for the closure construction for the neck of a container over that taught in U.S. Pat. No. 3,120,908. The closure of the present invention is composed of resilient material and, as in the prior art, includes a cap-like member, which cap in this case has a convex end wall and a depending skirt. The skirt is designed to interlock with the exterior surface of the neck or other outlet of the container to which it is attached, and form a seal therewith. The inner surface of the convex end wall will have a seal projecting therefrom in substantially concentric relation with respect to the skirt. The seal is somewhat analogous to the plug of U.S. Pat. No. 3,120,908, but is far more complex. The seal of the present invention is substantially hollow, but the portion of its inner body which is immediately adjacent to and connected to the inner surface is immediately adjacent to and connected to the inner surface of the end wall will be substantially in the Nos form of a truncated cone which expands in diameter as its distance from the end wall increases, while the protion of the inner body of the seal which is removed from the end wall, beginning at the base of the truncated cone, will be substantially in the form of a right cylinder. A plurality of stiffening ribs are axially arrayed around the inner surface of the combined cone and cylinder. This combination of shapes and ribs provides the seal with shape retention and rapid spring back characteristics. The outer surface of the cylindrical portion of the seal has an outwardly directed tapered lip, which is designed to engage the internal surface of the neck or other outlet of the container to form a fluid tight seal. The outwardly directed tapered No. lip is somewhat analogous to the upwardly facing circular seat of U.S. Pat. No. 3,190,908; however, a portion of the outer surface of the tapered lip and the outer surface of the truncated cone merge to provide a structure which continuously urges the lip against the inner surface of the neck of the container.

The convex end wall of the closure is designed so that when it is depressed only a portion of it is readily inwardly movable. This limited movement of the end wall will in turn effect the unseating of only a limited portion of the lip of the seal from the internal surface of the neck to thus allow a controlled flow of fluids through the closure. In preferred embodiments, movement of only a limited portion of the end wall is accomplished by providing a scoreline having a reduced wall thickness around a segment of the convex outer circular surface of the end wall. Because of the reduced wall thickness along the scoreline, inward pressure in the vicinity of the segment circumscribed by the scoreline will cause ready inward movement of only the circumscribed portion of the end wall. Such inward movement of only a portion of the end wall will cause only the portion of the body of the seal which is attached to the inner surface of the end wall which is enclosed by the scoreline to move inwardly. Such inward movement by only a portion of the body of the seal will in turn unseat the portion of the lip which is associated with that portion of the body of the seal from the container neck to form an opening through which fluid can flow. The balance of the body of the seal will remain unmoved, and the portion of the lip associated with the portion of the body which is unmoved will in turn remain unmoved and in tight sealing relationship with the container neck. This controlled movement of only a portion of the seal, is enhanced by providing the portion of the seal which depends from the portion of the end wall circumscribed by the scoreline with a bridging structure. Such a bridging structure assures that the portion of the seal with which it is associated will move inwardly as a unit when pressure is applied to the outer surface of the convex end wall in the vicinity of the segment which is circumscribed by the scoreline. As previously noted the remainder of the complex inner conical and cylindrical surface of the seal is reinforced by axial ribs, otherwise structured in such a manner that it resists inward movement when inward pressure is applied to any portion of the outer surface of the end wall. Such structure and reinforcement will also assure that the cylindrical portion of the seal behind the outwardly directed tapered lip, will retain its substantially cylindri-cal shape, and thus uniformly urge the lip against the inner wall of the neck of the container to provide a tight seal.

There will also be provided a dispensing opening through the portion of the end wall intermediate the skirt and the scoreline. The dispensing opening will preferably open through a spout structure, a portion of which spout structure is formed integral with the end wall and a portion of which will depend from the skirt of the closure. The provision of a spout will quell the turbulence of the flowing fluid, and will also make it readily apparent to the user how the container is to be oriented. A spout will also make it possible for a user to transfer fluid from the container to another container, or through a small opening without a funnel, and without spillage. In preferred embodiments an air venting system will also be provided as an integral portion of the closure. The provision of such an air vent will avoid the build up of a vacuum in the container as the fluid contents of the container are dispensed, and will thus avoid the necessity of puncturing the container as is the common practice in many dispensing situations.

A modified form of the container of the present invention, which is capable of being locked to render it child resistant, is also disclosed. In preferred embodiments of this modified form, the bulk of the closure construction is substantially as set forth above. However, the cylindrical wall of the seal will have at least one tab or ramp which will extend axially away from the portion of the seal which is in registration with the portion of the end wall which is circumscribed by the scoreline. In this version the inner wall of the neck of the container will be modified to carry at least one shoulder. The shoulder carried by the neck will be at a distance from the open end of the neck such that it will not normally make contact with the base of the seal; but, when the closure is rotated to place the tab extending from the base into axial alignment with the shoulder, the shoulder will make substantial surface-to-surface contact with the tab extending from the seal. When the axially extended tab on the seal and the shoulder on the neck are aligned in substantial surface-to-surface contact the portion of the seal circumscribed by the score line will be blocked from moving inwardly, the seal will not be capable of being opened and no liquid can be dispensed from the container.

Such a child resistant closure system will be preferred for use with non-potable fluids, and especially poisonous and dangerous fluids, such as anti-freeze, paint thinners, bleach and pesticides. As explained in greater detail below, when the closure is locked, if it is subjected to extreme inward pressure the walls of the seal will bulge in a manner which will not only avoid leaking, but will actually increase the tightness of the seal. In preferred embodiments this lockable closure will have at least two extended tabs on the seal and two shoulders on the inner surface of the wall of the neck, each such pair of tabs and pair of shoulders being about 180° to one another. A plurality of more than two tabs and shoulders can also be used in substantially equal array around the seal and the neck. It will be appreciated that the provision of more than one set of blocking tabs and shoulders will, when in a locked position, tend to distribute inward pressure from the seal to the neck, and thus avoid leakage. It is thus seen that this modified form of the present invention provides a lockable, child resistant closure system which has special utility for use with poisonous and dangerous fluids.

It is therefore the primary object of the present invention to provide a novel container closure of the dispensing type, which container closure is of extremely simple, one-piece construction which is provided with efficient valve means, whereby the necessity of a separate closure cap for the dispensing spout is eliminated, while retaining the simplicity of design of a valveless type container closure.

Another object of the invention is to provide a one-piece closure for containers wherein the closure is composed of resilient material and which can be connected integrally with the neck or other outlet opening of a container, and which is provided with a valve structure which is normally closed.

Another object of the invention is to provide a modified form of a dispensing actuator which is a novel one-piece closure for a container, the closure being generally in the form of a cap which may be readily connected to a neck or other outlet opening of a container, the closure being provided with a valve structure which is normally closed, but which valve structure includes a portion which is readily movable to an open position, whereby the fluid contents of the container may be dispensed.

Another object of the invention is to provide a leak resistant closure which need not be removed from the container and which is normally closed, whereby, no spillage or leakage of the fluid contents of the container will occur should the container be accidentally toppled or intentionally maintained with the closure in a constant gravity fed position.

Another object of the present invention is to provide a drip-proof dispenser closure for viscous and semi-viscous fluids.

Another object of the invention is to provide a closure with a defined spout for the transfer of fluids from a container into another container or through a small opening without the use of a funnel, and with no spillage.

Another object of the invention is to provide a closure whereby the greater the fluid pressure of the contents of the container on the closure, the stronger the sealing action of the closure becomes.

Another object of the invention is to provide a closure including an air vent which avoids the build up of a vacuum in the container as fluids are dispensed, without the need to perforate the walls of the container.

Another object of the invention is to provide a modified form of the closure which is child resistant.

Another object of the invention is to provide a closure of the dispensing type, whereby, the spout can be sealed to prevent premature dispensing or unauthorized tampering with the contents.

The provision of container closure systems, such as those set forth above and possessing the stated advantages, constitutes the principal object of the present invention.

These and other objects of the present invention will become apparent to those skilled in the art from the following detailed description, showing the contemplated novel construction, combination, and arrangement of elements as herein described, and more particularly defined by the appended claims, it being understood that changes in the precise embodiments of the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which:

FIG. 1 is a front elevational view of the closure of the present invention.

FIG. 2 is a rear perspective, sectional view of the closure taken along line 2—2 of FIG. 1, showing the closure positioned on the fragmentary sectional neck of a container to which it is attached, and showing specific details of the closure, in its normally closed and sealed position.

Figure 3:
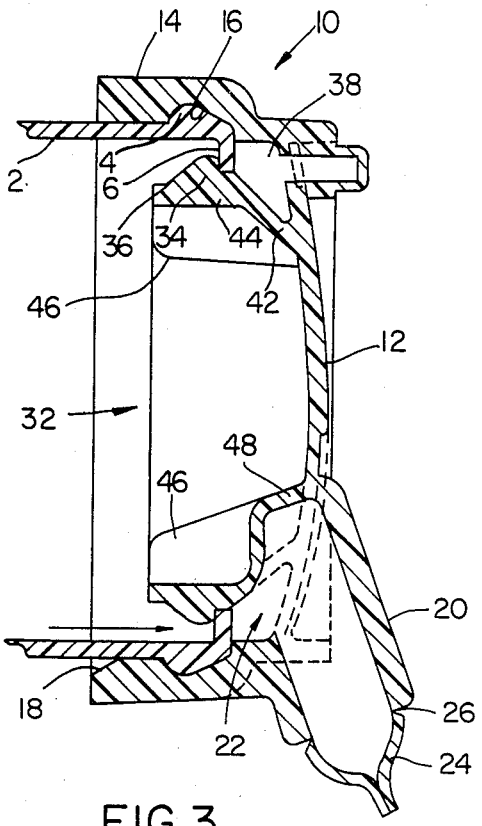
FIG. 3 is a vertical sectional view, partially in phantom, also taken along line 2—2 of FIG. 1, and showing the specific details of the closure in its normally closed and sealed position with respect to the fragmentary sectional neck of a container, but with the spout sealed.
Figure 4:
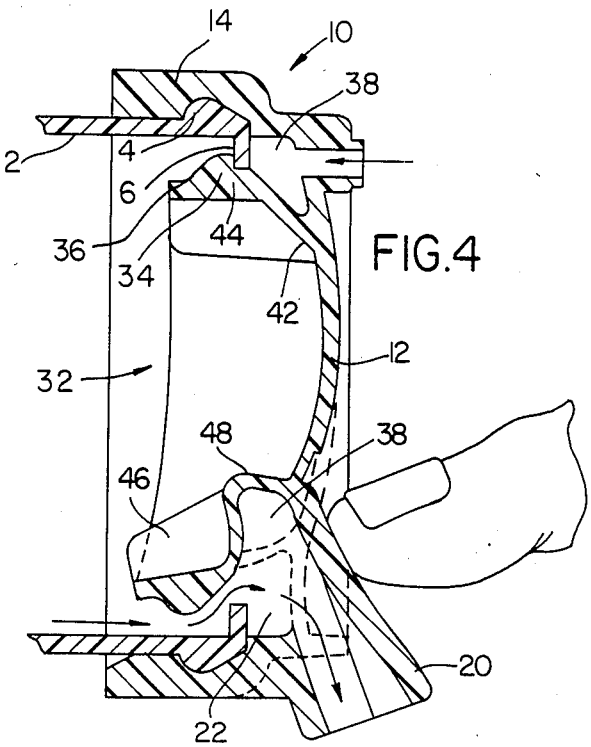
FIG. 4 is a sectional view similar to FIG. 3, and shows the container and closure after the spout and the vent have been rendered operative, and with the closure being operated to allow fluid to flow from a portion of the closure.

Referring now to the drawings in detail, it will be seen that there is illustrated in the FIGS. 2, 3 and 4 a cross-section of a fragment of a neck or other outlet, generally 2. Neck 2 is connected to a container, not shown, for a potable or non-potable fluid. In preferred embodiments, neck 2 is provided with an external outwardly directed bead substantially adjacent to, but spaced from its open outer end, and is further provided with an inwardly directed lip 6 at its open outer end. Although the container neck is illustrated as being formed of plastic, it should be understood that the container may be formed of any other suitable material such as metal, glass or the like.

The closure, which will generally be referred to by the numeral 10, when positioned for operative use, will be carried by neck 2. Closure 10 will generally be of a cap-shaped configuration and will include a convex end wall 12 having an axially extending circumferential skirt 14. When neck 2 includes a bead 4, skirt 14 will be provided with an internal annular groove 16 designed to receive bead 4, thereby interlocking closure 10 with neck 2 and forming a substantially permanent outer seal between them. Skirt 14 will also have an internal tapered portion 18 to facilitate the movement of circumferential skirt 14 over bead 4 of neck 2. It will be noted that when closure 10 has been properly secured to neck 2, convex end wall 12 will be spaced outwardly from the end of neck 2. The purpose of this arrangement will be set forth in additional detail below. In the preferred embodiments shown, a dispensing spout 20 is connected integrally with and through the convex end wall 12 and is also connected to an adjacent portion of skirt 14. Convex end wall 12 may also be considered as having a dispensing opening 22 therethrough. Dispensing opening 22 will be in registration with and feed dispensing spout 20. In preferred embodiments spout 20, as formed, will include a spout end 24 connected thereto at tear-line 26. When used with a container which contains a fluid, spout end 24 may be closed, as shown in FIG. 3, for example by heat sealing. Sealed spout end 24 will be subject to easy removal, for example by cutting or tearing along tear-line 26, thus making it possible for fluids to flow through spout 20, as shown in FIG. 4.

A complex open hollow seal, generally 32 depends from the inside surface of convex end wall 12 in a spaced apart, substantially concentric relation to skirt 14. Seal 32 has an external tapered lip portion 34 which faces outwardly towards skirt 14. The end portion 36 of seal 32 will be tapered to facilitate the movement of the seal 32 past internal lip 6 on neck 2, and into the interior of neck 2. When seal 32 is positioned on neck 2, as shown in FIGS. 2 and 3, with its lip 34 in contact with the internal wall and/or lip 6, the closure system is in its normally closed and sealed position. It will be seen that a substantially torroidal channel 38 is formed in the space defined by the outer surface of lip 6, the portion of circumferential skirt 14 and the adjacent inner surface of end wall 12 which are spaced outwardly from the end of neck 2, and the outer surface of seal 32. An air vent 40 is positioned through end wall 12 of closure 10 in substantial diametric opposition to spout 20. In preferred embodiments air vent 40 will be formed in a closed condition, as shown in FIGS. 1–3. When closure 10 is readied for dispensing operation the outer end of vent 40 will be cut or punctured as shown in FIG. 4. With vent 40 thus provided, during fluid dispensing operations external air can enter vent 40, travel through channel 38 and enter the container through dispensing opening 22. This will avoid the formation of a partial vacuum in the container, as fluids are dispensed, without the need to puncture the container walls. Channel 38 and the top of spout 20 also serve to provide a reservoir of space which will quell turbulence in the fluid as it exits from dispensing opening 22.

Referring now to FIGS. 1–4, additional details of the closure are provided. The portion of complex hollow seal 32 adjacent to, connected to the inner surface of end wall 12 will be substantially in the form of a truncated cone 42. It can be seen that the outer surface of truncated cone 42 extends to and substantially merges with the tapered external surface of lip 34. This convergence of the elements and shapes of seal 32 thus serves to assist in urging lip 34 against the internal wall and lip 6 of neck 2. The portion of the inner surface of the portion of inner body of hollow seal 32 which is axially spaced from the inner surface of end wall 12, starting at the base of truncated cone 42 is substantially in the form of a right cylinder 44. A plurality of inwardly extending axial ribs 46 are arranged circumferentially around the inner surface of hollow seal 32 and extend between conical surface 42 and cylindrical surface 44. Ribs 46 integrate surfaces 42 and 44 and provide firmness to the inner surface of the wall of seal 32 and thereby also serve to assist in retaining the desired generally cylindrical shape of cylindrical portion 44. The retention of the cylindrical shape of portion 44 serves to assure uniform support and form to external lip 34, which in turn assists in holding and urging lip 34 in normally closed sealing contact with the inner surface and lip 6 of neck 2. Also within hollow seal 32 is bridging member 48. Member 48 serves the triple function of defining the top of spout 20, of substantially integrating the portion of seal 32 which is moved out of sealing contact with the inner surface and lip 6 of neck 2 when end wall 12 is depressed, and of transmitting pressure which is applied to the surface of convex end wall 12 through spout 20 to the portion of seal 32 which is moved out of sealing contact when end wall 12 is depressed, as explained in additional detail below.

As shown, for all but spout portion 20, convex end wall 12 is substantially encircled by open axially extending cylindrical wall 50. The circumferential portion of end wall 12 adjacent to cylindrical wall 50 carries a scored portion 52 having bracing ribs 54 thereacross. An additional scored portion 56 surrounds the upper portion of spout 20, separating it from end wall 12. Bracing ribs 58 extend across scored portion 56. The segment of end wall 12 and spout 20 circumscribed by scoreline 56 is in substantial registration with bridging member 48 and the portion of seal 32 which is intended to be moved inwardly out of sealing contact with the inner surface and lip 6 of neck 2 when inward pressure is exerted on end wall 12 in the vicinity of scoreline 56. The conjunction of bracing ribs 54 between cylindrical wall 44 and end wall 12 serves to urge end wall 12 to return to its convex shape after it has been depressed and released. Similarly, ribs 58 serve to urge spout 20 to return to its normal position after it has been depressed and released. Scoreline 56 serves to cause the preferential inward movement of the upper portion of spout 20 when inward pressure is applied in the vicinity of the scoreline 56.

It will be understood that when closure 10 is properly assembled on neck 2, seal 32 will be in the position illustrated in FIGS. 2 and 3, with a portion of tapered external lip 34 engaging the inside surface and internal lip 6 of neck 2 to form a fluid tight seal therewith. Seal 32 will be dimensioned with regard to the inside surface of neck 2 and its internal lip 6 so that the tapered lip 34 of seal 32 will normally be in compressive engagement with the inside surface and internal lip 6 of neck 2.

It will thus be seen that the engagement of lip 34 of seal 32 with the inside surface and internal lip 6 of neck 2 prevents the escape of the fluid contents of the container through dispensing opening 22. Thus, even when spout end portion 24 of spout 20 has been removed, so that spout 20 has an open end, as in FIG. 4, leakage of the contents of the container through spout 20 will be prevented.

In accordance with the invention, and as illustrated in FIG. 4, when it is desired to dispense the contents of a container, not shown, through the dispensing opening 22, convex end wall 12 will be depressed in the vicinity of the top of spout 20, preferably below score line 56, so that the upper portion of spout 20 within scoreline 56 will be moved towards the interior of neck 2. This will then result in the inward movement of bridge 48, which will in turn cause the inward movement of the adjacent portion of seal 32, and with it a portion of lip 24. This will cause the portion of lip 24 which is moved to separate from the adjacent portion of the inner surface and internal lip 6 of neck 2, and will allow the fluid contents of the container to be free to flow out of the container through dispensing opening 22 and dispensing spout 20, as indicated by the arrows in FIG. 4. However, due to the resiliency of the material from which closure 10 is formed, and its structure, once the end wall 12 is released it will be flexed into its normal convex shape, and seal 32 will quickly return to its normal sealing position by the action of truncated cone 42 and ribs 46.

Figure 7:
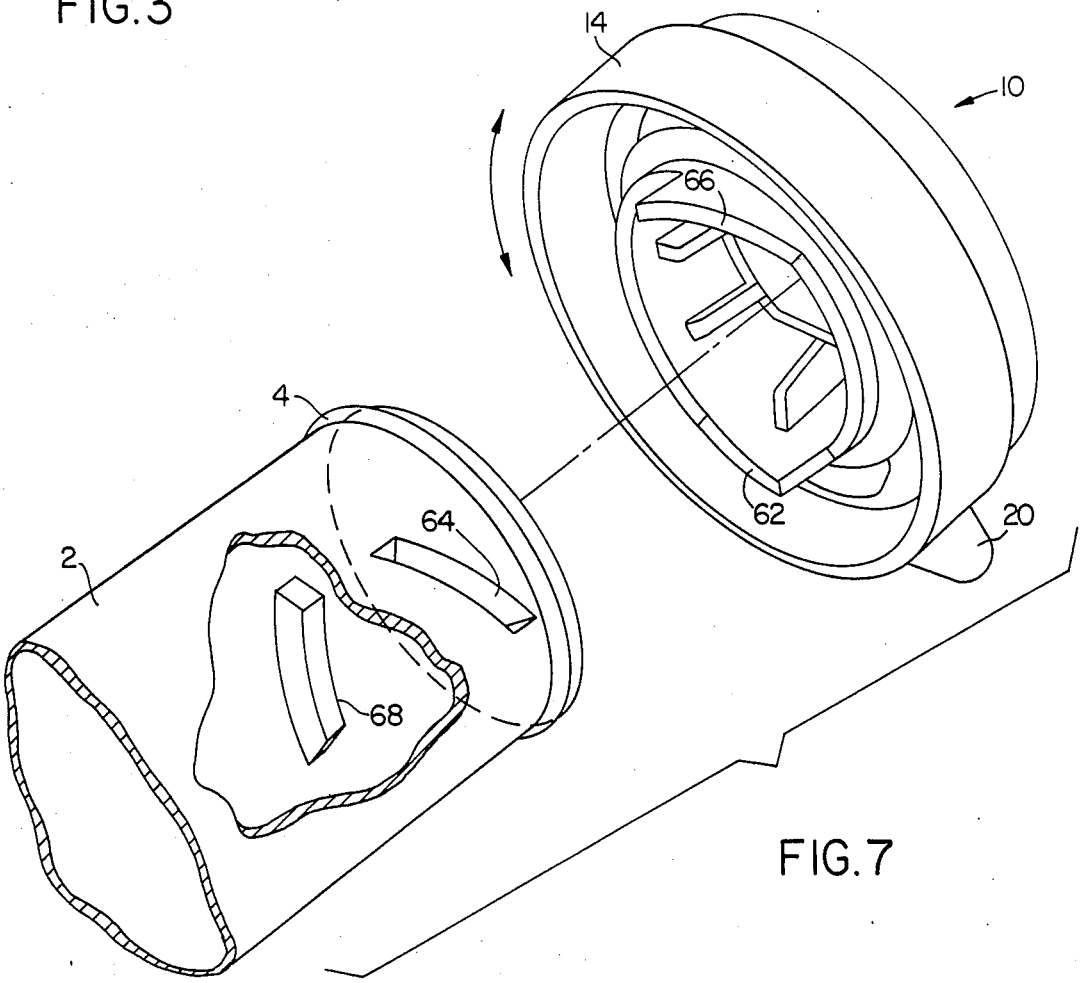
FIG. 7 is an exploded rear perspective view with the fragmentary neck of the container partially broken away to show additional details of the modified closure of FIGS. 5 and 6.
Figure 5:
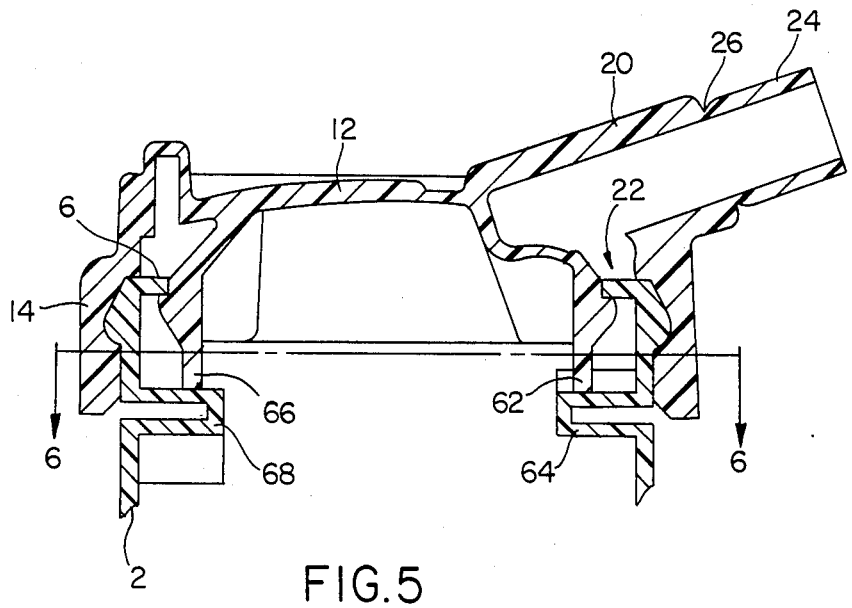
FIG. 5 is a sectional view similar to FIG. 3, but taken through the center of a modified form of the closure positioned on the fragmentary sectional modified neck of a container, with the closure in a sealed and locked position.
Figure 6:
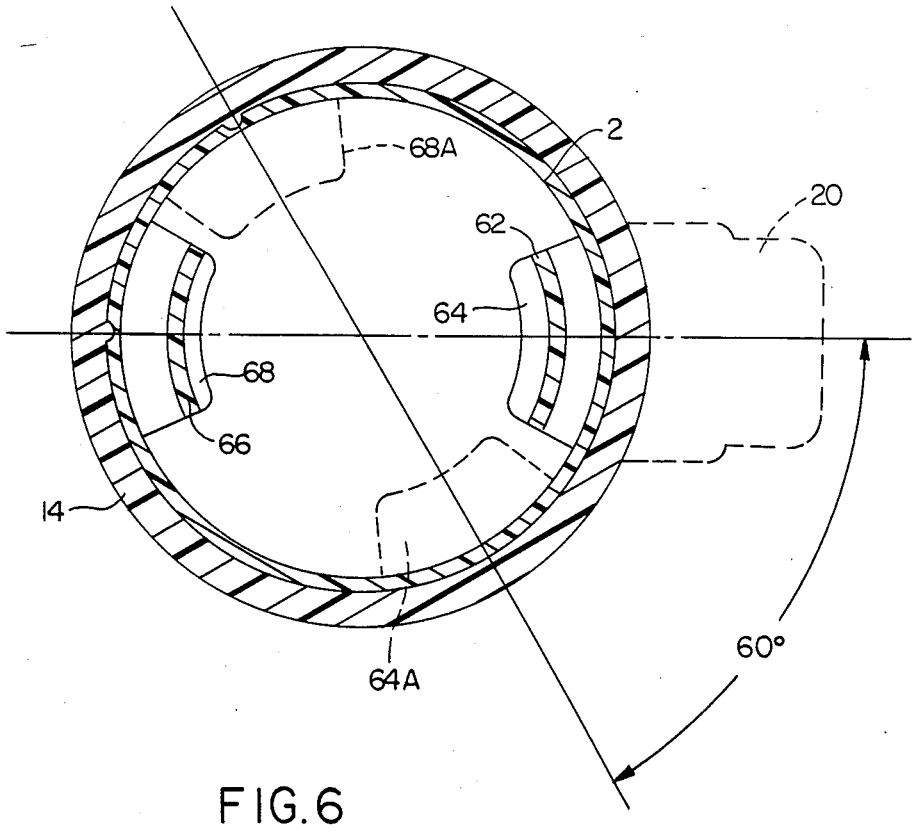
FIG. 6 is a view taken along reference line 6—6 of the modified form of the closure of FIG. 5 showing details of the closure locking mechanism and showing in phantom the orientation of the spout and the relative location of the neck when the closure is moved to an unlocked position.

A modified form of the container which is capable of being locked to render it child resistant is disclosed in FIGS. 5, 6 and 7. In preferred embodiments of this modified form the closure construction may be substantially as set forth above, and like numerals therein represent like parts. However, in this modified form cylindrical portion 44 of seal 32 has at least one tab or ramp 62 which is substantially aligned with and which axially extends from the end portion of seal 32 which is in registration with the portion of the inner surface of end wall 12 which is circumscribed by scoreline 56. The inner wall of neck 2 of the container is also modified to carry at least one shoulder 64. Shoulder 64 is at a distance from the open end of neck 2 such that shoulder 64 will not normally make contact with the base of seal 32. However, shoulder 64 will be at such a distance from the end of neck 2 that it will make substantial surface-to-surface contact with tab 62 when closure 10 is rotated, for example by 60°, to place tab 62 into axial alignment with shoulder 64. When axially extended tab 62 and shoulder 64 are so aligned that they are in substantial surface-to-surface contact, the portion of seal 32 circumscribed by scoreline 56 will be blocked from being moved inwardly when pressure is applied to the outer surface of end wall 12. When seal 32 cannot be moved inwardly its external lip 34 will remain in its normally sealed relation with the inner surface and lip 6 of neck 2, and no liquid can be dispensed from the container through closure 10. When the closure is so locked, if it is subjected to extreme inward pressure the walls of the seal will bulge into chamber 38 and around lip 6 in a manner, not shown, to further increase the tightness of the seal.

As shown, in preferred embodiments this modified lockable closure will have a second axially extended tab 66 on the base of seal 32 and a second shoulder 68 on the inner surface of the wall of neck 2, each tab and each shoulder being in about 180° opposition to each other tab and each other shoulder. The provision of such additional tabs and shoulders assists in equalizing pressure which is exerted against closure 10. Additional tabs and shoulders, more than two, may be arranged around the structure. The ramp structure shown for tabs 62 and 66 and the angular orientation shown for shoulder 64 and 68 provide a mechanism by which rotation of closure 10 will assure the ability to make tight surface-to-surface locking contact between at least a portion of the surfaces of ramped tabs 62 and 66 and the angular shoulders 64 and 68.

Referring to FIGS. 5 and 7 it is seen that shoulder 64 and 68 may be easily and economically formed as indentations in neck 2. Referring to FIG. 6, the orientation of spout 20 relative to tabs 62 and 66, when the closure is rotated into its locked position, is shown in phantom, it being understood that spout 20 is actually above the plane of FIG. 6. FIG. 6 also shows the position that the shoulders, identified as 64A and 68A will take relative to unmoved tabs 62 and 66 when the closure is rotated out of its locked position. It is thus seen that this modified from of the present invention provides a lockable, child resistant closure system.

While outlet neck 2 has been shown as having an internal lip 6, the present invention may be successfully operated with an outlet having no internal lip.

It will be noted from the FIGURES that scoreline 56 intersects about 90° of the circumferential arc of end wall 12. Scoreline 56 will never intersect more than about 170° of the peripheral arc of end wall 12, and preferably will intersect from about 15° to about 120° of the circumferential arc. It is therefore seen that the primary objects of the present invention have been achieved by the present invention as herein described.

The present invention provides a novel container closure of the dispensing type which is of extremely simple, one-piece resilient material construction. It is provided with efficient valve means, which do not require a separate closure cap for the dispensing opening, while retaining the simplicity of design of a valveless type of container closures. The closure is generally in the form of a cap which may be readily connected integrally to a neck or other outlet opening of a container, the closure being provided with a valve structure which is normally closed, but which valve structure includes a portion which is readily movable to an open position in order to dispense the fluid contents of the container. The resulting closure is leak resistant so that no spillage or leakage of the fluid contents of the container will occur should the container be accidentally toppled or intentionally maintained with the closure in a constant gravity fed position. It also provides a drip-proof dispenser closure for viscous and semi-viscous fluids from squeezable containers, as release of such a container will draw such fluids back into the container. The spout of the closure provides a means for the transfer of fluids from the container to which it is attached into another container or through a small opening without the use of a funnel. The spout can also be sealed to prevent premature dispensing or tampering with the contents. Additionally, the closure may include an air vent which may be closed before the closure is intended for use, and which, when open avoids the build up of a vacuum in the container as fluids are dispensed without the need to perforate the walls of the container.

A modified form of the closure which is lockable and child resistant has also been taught.

From the foregoing, it will be seen that novel and advantageous provision has been made for carrying out the desired objects. While the invention has been particularly shown and described with reference to preferred embodiments thereof, it will be understood by those skilled in the art that the foregoing and other modifications or changes in form and details may be made therein without departing from the spirit and scope of the invention as claimed, except as precluded by the prior art.

The embodiments of the invention in which an exclusive property or privilege is claimed are defined as follows:

1. A one-piece dispensing closure for a container having an open substantially cylindrical outlet, which outlet has an outer surface, an inner surface and an open end, said closure comprising in combination:

a cap like member including a resilient and deformable substantially circular end wall having a depending peripheral skirt, said end wall having an outer surface and an inner surface, said end wall including a scoreline having a reduced wall thickness carried on its said outer surface which scoreline defines a segment intersecting less than about 170° of circumferential arc of said substantially circular end wall, said peripheral skirt having an inner surface of a size and construction for securing it to the exterior surface of the container outlet;

a resilient and deformable complex seal depending from said inner surface of said end wall in substantial spaced concentric relation to said peripheral skirt, said seal positioned and sized for insertion into the open end of the container outlet, said seal further being comprised of a first and a second body portion, said first body portion of said seal immediately adjacent to and depending from the inner surface of said end wall being substantially in the form of a hollow cone having an inner surface, an outer surface and a base, which cone increases in diameter as its distance from said end wall increases, while said second body portion of said seal begins at and is integral with said base of said cone and is substantially in the form of a hollow cylinder having a base and having substantially the same diameter as the diameter of said base of said cone, said complex seal further having a tapered external lip for normally forming a partially releasable seal with the internal surface of the container outlet, said tapered lip being located substantially circumferentially around and carried by said hollow cylindrical second body portion of said seal;

a dispensing opening through said end wall substantially within said segment defined by said scoreline and intermediate said peripheral skirt and said outer surface of said cone; whereby when inward pressure is exerted on said end wall in the vicinity of said scoreline a substantial portion of said end wall within said scoreline is moved inwardly, the portion of said seal which is in substantial registration with said scoreline is moved inwardly with said end wall and a substantial portion of said tapered lip carried by said inwardly moved portion of said seal is also moved inwardly and thereby released from sealing relation with the inner surface of the outlet with which it is normally sealed, while the portion of said seal which is outside of said scoreline remains substantially unmoved and the portion of said tapered lip carried by said unmoved portion of said seal also remains substantially unmoved and in sealing relation with the inner surface of the outlet, and whereby further, when inward pressure on said end wall is terminated said inwardly moved portion of said end wall and said seal quickly move outward and return said inwardly moved portion of said tapered lip to its normal sealing relation with the inner surface of the outlet.

2. The dispensing closure of claim 1 wherein said cone of said first body portion of said seal is a truncated cone.

3. The dispensing closure of claim 1 wherein the outer surface of said cone substantially merges with the outer surface of said tapered lip, whereby said tapered lip is continuously urged against the inner surface of the outlet to form a fluid tight seal.

4. The dispensing closure of claim 1 wherein said inner surface portions of said first and second body portions of said complex seal carry a plurality of axially arranged stiffening ribs for providing shape retention and rapid spring back characteristics to said seal and thereby to said tapered lip carried by said seal.

5. The dispensing closure of claim 4 wherein said stiffening ribs extend between and join the inner surfaces of said cone and said cylinder body portions.

6. The dispensing closure of claim 4 wherein said cone portion of said seal is a truncated cone, and the outer surface of said cone substantially merges with the outer surface of said tapered lip, whereby said tapered lip is continuously urged against the inner surface of the outlet to form a fluid tight seal.

7. The dispensing closure of claim 1 wherein said scoreline intersects from about 15° to about 120° of circumferential arc of said substantially circular end wall.

8. The dispensing closure of claim 1 wherein a spout is present at least partially integral with said outer surface of said end wall and substantially within said scoreline and wherein said spout substantially encloses said dispensing opening.

9. The dispensing closure of claim 8 wherein a portion of said spout is integral with said end wall and a portion of said spout is carried by said peripheral skirt.

10. The dispensing closure of claim 8 wherein said spout includes a top wall which is integral with and which also substantially bridges the portion of said end wall which is circumscribed by said scoreline, whereby when inward pressure is applied to the end wall in the vicinity of said scoreline said inward pressure is transmitted to a portion of said seal by said top wall of said spout.

11. The dispensing closure of claim 8 wherein said spout carries an end portion which is both sealable and removable.

12. The dispensing closure of claim 1 wherein said complex seal includes a bridging member which is substantially integral with the portion of the seal which is in registration with the portion of said end wall which is circumscribed by said scoreline, whereby when inward pressure is applied to said end wall in the vicinity of said scoeline such inward pressure is transmitted by said bridging member to the portion of the seal which is in registration with the portion of said end wall which is circumscribed by said scoreline.

13. The dispensing closure of claim 1 wherein said end wall is spaced from the end of the outlet and an open torroidal chamber is formed intermediate said inner surface of said closure and the container outlet, which said open torroidal chamber intersects with at least a portion of said dispensing opening, and wherein further there is a vent through said closure to said torroidal chamber which vent allows air to enter said chamber and thence to enter the container through said dispensing opening when fluids are dispensed, whereby the formation of a partial vacuum is avoided.

14. The dispensing closure of claim 1 wherein said outer surface of said resilient deformable end wall is convex, whereby when said end wall has inward pressure applied to it said end wall moves inward, and then, when said inward pressure is released said convex end wall resumes its convex shape, thereby urging said seal to resume its normal position.

15. The dispensing closure of claim 1 wherein said said closure is rotatable, said seal has a base and at least one tab extends axially away from said base portion of said seal which is in substantial registration with said scoreline; and wherein there is at least one shoulder located on said inner surface of said outlet at a distance from said open end of said outlet such that said shoulder will not normally make contact with said base of said seal, but at such a distance that said shoulder will make contact with said axially extending tab on said seal when the closure is rotated into axial alignment with said shoulder so that the portion of said seal which is in substantial registration with said scoreline will be blocked from being moved inwardly.

16. A one-piece dispensing closure for a container having an open substantially cylindrical outlet, which outlet has an outer surface, an inner surface and an open end terminating in an inwardly directed peripheral lip, said closure comprising in combination:

a cap like member including a resilient and deformable substantially circular convex end wall having a depending peripheral skirt, said end wall having an outer surface and an inner surface, said end wall including a scoreline having a reduced wall thickness carried on its said outer surface which scoreline defines a segment intersecting from about 15° to about 120° of circumferential arc of said substantially circular end wall, said peripheral skirt having an inner surface of a size and construction for securing it to the exterior surface of the container outlet;

a resilient and deformable complex seal depending from said inner surface of said end wall in substantial spaced concentric relation to said peripheral skirt, said seal positioned and sized for insertion into the open end of the container outlet, said seal further being comprised of a first and a second body portion, said first body portion of said seal immediately adjacent to and depending from the inner surface of said end wall being substantially in the form of a hollow truncated cone having an inner surface, an outer surface and a base, which truncated cone increases in diameter as its distance from said end wall increases, while said second body portion of said seal begins at and is integral with said base of said truncated cone and is substantially in the form of a hollow cylinder having a base and having substantially the same diameter as the diameter of said base of said truncated cone, said complex seal further having a tapered external lip for normally forming a releasable seal with the internal surface and the inwardly directed peripheral lip of the container outlet, said tapered lip being located substantially circumferentially around and carried by said hollow cylindrical second body portion of said seal, and wherein the outer surface of said tapered lip substantially merges with the outer surface of said truncated cone, whereby said tapered lip is continuously urged against the inner surface and the inwardly directed peripheral lip of the outlet to form a fluid tight seal;

a plurality of stiffening ribs, said ribs axially arranged around said inner surface portions of said first and second body portions of said complex hollow seal and extending between and joining said truncated cone and said cylinder, said ribs providing shape retention and rapid spring back characteristics to said seal and to said tapered lip carried by said seal;

a bridging member, said bridging member being substantially integral with the portion of the seal which is in registration with the portion of said end wall which is circumscribed by said scoreline, whereby when inward pressure is applied to said end wall in the vicinity of said scoreline said inward pressure is transmitted to a portion of said seal by said bridging member;

a dispensing opening through said end wall substantially within said segment defined by said scoreline and intermediate said peripheral skirt and said outer surface of said truncated cone; whereby when inward pressure is exerted on said convex end wall in the vicinity of said scoreline a substantial portion of said end wall within said scoreline is moved inwardly, and such inward pressure is transmitted by said bridging member to the portion of said seal which is in substantial registration with said scoreline member to move said portion of said seal inwardly with said end wall, whereby a substantial portion of said tapered lip carried by said inwardly moved portion of said seal is also moved inwardly and thereby released from sealing relation with the inner surface of the outlet with which it is normally sealed, while the portion of said seal which is outside of said scoreline remains substantially unmoved and the portion of said tapered lip carried by said unmoved portion of said seal also remains substantially unmoved and in sealing relation with the inner surface and the inwardly directed tapered lip of the outlet, and whereby further, when inward pressure on said end wall is terminated said inwardly moved portion of said end wall and said seal quickly move outward and return said inwardly moved portion of said tapered lip to its normal sealing relation with the inner surface and the inwardly directed tapered lip of the outlet.

17. The dispensing closure of claim 16 wherein a spout is present, said spout being at least partially integral with said outer surface of said end wall and partially carried by said peripheral skirt, said spout being located substantially within said scoreline and substantially enclosing said dispensing opening.

18. A normally unlocked, lockable one-piece dispensing closure system for a container, said closure system comprising in combination:

a substantially cylindrical outlet for a container, which outlet has an outer surface, an inner surface and an open end;

a cap like member including a resilient and deformable substantially circular end wall having a depending peripheral skirt, said end wall having an outer surface and an inner surface, said end wall including a scoreline having a reduced wall thickness carried on its said outer surface which scoreline defines a segment intersecting less than about 170° of circumferential arc of said substantially circular end wall, said peripheral skirt having an inner surface of a size and construction for rotatably securing it to the exterior surface of the container outlet;

a resilient and deformable substantially hollow seal depending from said inner surface of said end wall in substantial spaced concentric relation to said peripheral skirt, said seal positioned and sized for insertion into said open end of said container outlet, said seal having a tapered external lip located substantially circumferentially around and carried by said seal for normally forming a releasable seal with the internal surface of said container outlet, said seal also having a base, and at least one tab extending axially away from the base portion of said seal which is in substantial registration with said scoreline;

at least one shoulder located on said inner surface of said outlet at a distance from said open end of said outlet such that said shoulder will not normally make contact with said base of said seal, but at such a distance that said shoulder will make contact with said axially extending tab on said seal when said closure is rotated into axial alignment with said shoulder so that the portion of said seal which is in substantial registration with said scoreline will be blocked from being moved inwardly;

a dispensing opening through said end wall substantially within said segment defined by said scoreline and intermediate said peripheral skirt and said outer surface of said cone; whereby when inward pressure is exerted on said end wall in the vicinity of said scoreline and said tab and said shoulder are not axially aligned and in blocking contact, a substantial portion of said end wall within said scoreline is moved inwardly, the portion of said seal which is in substantial registration with said scoreline is moved inwardly with said end wall and a substantial portion of said tapered lip carried by said inwardly moved portion of said seal is also moved inward and thereby released from sealing relation with the inner surface of the outlet with which it is normally sealed, while the portion of said seal which is outside of said scoreline remains substantially unmoved and the portion of said tapered lip carried by said unmoved portion of said seal also remains substantially unmoved and in sealing relation with the inner surface of the outlet, and whereby further, when inward pressure on said end wall is terminated said inwardly moved portion of said end wall and said seal quickly move outward and return said inwardly moved portion of said tapered lip to its normal sealing relation with the inner surface of the outlet.

19. The closure system of claim 18 wherein there are at least two spaced apart tabs axially extending from said base of said seal, and wherein further there are at least two spaced apart shoulders carried by said inner surface of said outlet, said tabs and said shoulders being arrayed in a manner such that when said closure is rotated to place said tab which is in substantial registration with said scoreline in axial alignment with one said shoulder, then at least one other said tab is placed into axial alignment with at least one other said shoulder.

20. The closure system of claim 19 wherein said tabs have distal end surfaces which are in the form of an angular ramp and said shoulders have outer surfaces which are arrayed in substantially the same angular orientation as said distal end surfaces of said tabs.

* * * * *